US011062658B1

(12) United States Patent
Zheng et al.

(10) Patent No.: US 11,062,658 B1
(45) Date of Patent: Jul. 13, 2021

(54) PIXEL DRIVING CIRCUIT AND DISPLAY PANEL

(71) Applicant: Shenzhen China Star Optoelectronics Semiconductor Display Technology Co., Ltd., Guangdong (CN)

(72) Inventors: Lindiao Zheng, Guangdong (CN); Zhenling Wang, Guangdong (CN)

(73) Assignee: Shenzhen China Star Optoelectronics Semiconductor Display Technology Co., Ltd., Guangdong (CN)

( * ) Notice: Subject to any disclaimer, the term of this patent is extended or adjusted under 35 U.S.C. 154(b) by 0 days.

(21) Appl. No.: 16/765,484

(22) PCT Filed: Apr. 14, 2020

(86) PCT No.: PCT/CN2020/084722

§ 371 (c)(1),
(2) Date: May 20, 2020

(30) Foreign Application Priority Data

Mar. 31, 2020 (CN) ..... 202010245881.9

(51) Int. Cl.
*G09G 3/32* (2016.01)
*G09G 3/3266* (2016.01)

(52) U.S. Cl.
CPC ..... *G09G 3/3266* (2013.01); *G09G 2310/066* (2013.01); *G09G 2320/041* (2013.01); *G09G 2320/045* (2013.01); *G09G 2320/0626* (2013.01)

(58) Field of Classification Search
None
See application file for complete search history.

(56) References Cited

U.S. PATENT DOCUMENTS

| | | | | |
|---|---|---|---|---|
| 7,319,447 | B2 | 1/2008 | Hsueh | |
| 2011/0242083 | A1 | 10/2011 | Chiou | |
| 2015/0124004 | A1* | 5/2015 | Hayashi | G09G 3/3233 345/690 |
| 2017/0140704 | A1 | 5/2017 | Cai | |
| 2018/0123086 | A1* | 5/2018 | Oh | H01L 27/3262 |
| 2018/0218681 | A1 | 8/2018 | Cai | |
| 2019/0074341 | A1 | 3/2019 | Cai | |

FOREIGN PATENT DOCUMENTS

| | | | |
|---|---|---|---|
| CN | 100590691 | C | 2/2010 |
| CN | 105185300 | A | 12/2015 |
| CN | 106205495 | A | 12/2016 |
| CN | 107492344 | A | 12/2017 |
| CN | 110322835 | A | 10/2019 |

* cited by examiner

*Primary Examiner* — Carl Adams
(74) *Attorney, Agent, or Firm* — Mark M. Friedman

(57) ABSTRACT

A pixel driving circuit and a display panel are provided. The pixel driving circuit adopts a pixel driving circuit with a 4T1C structure to effectively compensate a threshold voltage of a driving transistor in each pixel. A compensation structure of the pixel driving circuit is simpler and easier to operate. By compensating the threshold voltage of the driving transistor through two compensation phases, it can achieve a wider compensation range of the threshold voltage, thereby improving brightness and a lifespan of the display panel.

14 Claims, 4 Drawing Sheets

PIXEL DRIVING CIRCUIT AND DISPLAY PANEL

FIELD OF INVENTION

The present disclosure relates to the field of display technology, and more particularly, to a pixel driving circuit and a display panel.

BACKGROUND OF INVENTION

Organic light-emitting diode (OLED) device display panels have the advantages of high brightness, wide viewing angles, fast response speed, low power consumption and so on, and have been widely used in the field of high-performance displays. Among them, in one OLED display panel, pixels are arranged in a matrix including multiple rows and columns. Each pixel is usually composed of two transistors and a capacitor, commonly known as a 2T1C circuit, but the transistor has a problem of threshold voltage drift. Therefore, the OLED pixel driving circuit requires a corresponding compensation structure. Currently, the compensation structure of the OLED pixel driving circuit has a relatively small range of threshold voltage compensation.

SUMMARY OF INVENTION

The purpose of the embodiments of the present disclosure is to provide a pixel driving circuit and a display panel, which can solve the technical problem that the compensation structure of the OLED pixel driving circuit has a relatively small range of threshold voltage compensation.

The present disclosure provides a pixel driving circuit, comprising a driving transistor, a first transistor, a second transistor, a third transistor, a capacitor, and a light-emitting device;

a gate of the driving transistor is electrically connected to a first node, a source of the driving transistor is electrically connected to a first power supply voltage, and a drain of the driving transistor is electrically connected to a second node;

a gate of the first transistor is electrically connected to a first control signal, a source of the first transistor is electrically connected to a data signal, and a drain of the first transistor is electrically connected to the first node;

a gate of the second transistor is electrically connected to a second control signal, a source of the second transistor is electrically connected to a first reference signal, and a drain of the second transistor is electrically connected to the second node;

a gate of the third transistor is electrically connected to the third control signal, a source of the third transistor is electrically connected to a second reference signal, and a drain of the third transistor is electrically connected to the first node;

one terminal of the capacitor is electrically connected to the first node, and another terminal of the capacitor is electrically connected to the second node;

an anode of the light-emitting device is electrically connected to the second node, a cathode of the light-emitting device is electrically connected to a second power supply voltage.

According to one embodiment of the pixel driving circuit of the present disclosure, the combination of the first control signal, the second control signal, and the third control signal sequentially corresponds to a first compensation phase and a second compensation phase;

during the first compensation phase, the third control signal is at a low electrical potential, the pixel driving circuit compensating a threshold voltage of the driving transistor according to the first control signal, the second control signal, the data signal, and the first reference signal;

during the second compensation phase, the third control signal is at a high electrical potential, the first control signal and the second control signal are both at the low electrical potential, the pixel driving circuit negatively drift the threshold voltage of the driving transistor according to the second reference signal.

According to one embodiment of the pixel driving circuit of the present disclosure, the first compensation phase comprises a reference electrical potential acquisition sub-phase, a threshold voltage acquisition sub-phase, and a light-emitting sub-phase; the data signal comprises a first reference electrical potential and a data electrical potential, the first reference signal comprises a second reference electrical potential;

during the reference electrical potential acquisition sub-phase, an electrical potential of the first node is the first reference electrical potential, an electrical potential of the second node is the second reference electrical potential;

during the threshold voltage acquisition sub-phase, the electrical potential of the first node is the first reference electrical potential, the electrical potential of the second node gradually changes from the second reference electrical potential to a difference between the first reference electrical potential and the threshold voltage of the driving transistor;

during the light-emitting sub-phase, the electrical potential of the first node is the data electrical potential, and the electrical potential of the second node is a difference electrical potential between the first reference electrical potential and the threshold voltage of the driving transistor.

According to one embodiment of the pixel driving circuit of the present disclosure, during the reference electrical potential acquisition sub-phase, both the first control signal and the second control signal are at the high electrical potential, an electrical potential of the data signal is the first reference electrical potential, an electrical potential of the first reference signal is the second reference electrical potential.

According to one embodiment of the pixel driving circuit of the present disclosure, during the threshold voltage acquisition sub-phase, the first control signal is at the high electrical potential, the second control signal is at the low electrical potential, and an electrical potential of the data signal is the first reference electrical potential.

According to one embodiment of the pixel driving circuit of the present disclosure, during the light-emitting sub-phase, the first control signal is at the high electrical potential, the second control signal is at the low electrical potential, and the electrical potential of the data signal is the data electrical potential.

According to one embodiment of the pixel driving circuit of the present disclosure, during the second compensation phase, an electrical potential of the second reference signal is the low electrical potential.

According to one embodiment of the pixel driving circuit of the present disclosure, all of the driving transistor, the first transistor, the second transistor and the third transistor are low-temperature polysilicon thin film transistors, oxide semiconductor thin film transistors or amorphous silicon thin film transistor.

According to one embodiment of the pixel driving circuit of the present disclosure, the light-emitting device is a light-emitting diode.

One embodiment of the present disclosure further provides a display panel including a pixel driving circuit, the pixel driving circuit comprising a driving transistor, a first transistor, a second transistor, a third transistor, a capacitor, and a light-emitting device;

a gate of the driving transistor is electrically connected to a first node, a source of the driving transistor is electrically connected to a first power supply voltage, and a drain of the driving transistor is electrically connected to a second node;

a gate of the first transistor is electrically connected to a first control signal, a source of the first transistor is electrically connected to a data signal, and a drain of the first transistor is electrically connected to the first node;

a gate of the second transistor is electrically connected to a second control signal, a source of the second transistor is electrically connected to a first reference signal, and a drain of the second transistor is electrically connected to the second node;

a gate of the third transistor is electrically connected to the third control signal, a source of the third transistor is electrically connected to a second reference signal, and a drain of the third transistor is electrically connected to the first node;

one terminal of the capacitor is electrically connected to the first node, and another terminal of the capacitor is electrically connected to the second node;

an anode of the light-emitting device is electrically connected to the second node, a cathode of the light-emitting device is electrically connected to a second power supply voltage.

According to one embodiment of the display panel of the present disclosure, the combination of the first control signal, the second control signal, and the third control signal sequentially corresponds to a first compensation phase and a second compensation phase;

during the first compensation phase, the third control signal is at a low electrical potential, the pixel driving circuit compensating a threshold voltage of the driving transistor according to the first control signal, the second control signal, the data signal, and the first reference signal;

during the second compensation phase, the third control signal is at a high electrical potential, the first control signal and the second control signal are both at the low electrical potential, the pixel driving circuit negatively drift the threshold voltage of the driving transistor according to the second reference signal.

According to one embodiment of the display panel of the present disclosure, the first compensation phase comprises a reference electrical potential acquisition sub-phase, a threshold voltage acquisition sub-phase, and a light-emitting sub-phase; the data signal comprises a first reference electrical potential and a data electrical potential, the first reference signal comprises a second reference electrical potential;

during the reference electrical potential acquisition sub-phase, an electrical potential of the first node is the first reference electrical potential, an electrical potential of the second node is the second reference electrical potential;

during the threshold voltage acquisition sub-phase, the electrical potential of the first node is the first reference electrical potential, the electrical potential of the second node gradually changes from the second reference electrical potential to a difference between the first reference electrical potential and the threshold voltage of the driving transistor;

during the light-emitting sub-phase, the electrical potential of the first node is the data electrical potential, and the electrical potential of the second node is a difference electrical potential between the first reference electrical potential and the threshold voltage of the driving transistor.

According to one embodiment of the display panel of the present disclosure, during the reference electrical potential acquisition sub-phase, both the first control signal and the second control signal are at the high electrical potential, an electrical potential of the data signal is the first reference electrical potential, an electrical potential of the first reference signal is the second reference electrical potential.

According to one embodiment of the display panel of the present disclosure, during the threshold voltage acquisition sub-phase, the first control signal is the high electrical potential, the second control signal is at the low electrical potential, and an electrical potential of the data signal is the first reference electrical potential.

According to one embodiment of the display panel of the present disclosure, during the light-emitting sub-phase, the first control signal is at the high electrical potential, the second control signal is at the low electrical potential, and the electrical potential of the data signal is the data electrical potential.

According to one embodiment of the display panel of the present disclosure, during the second compensation phase, an electrical potential of the second reference signal is the low electrical potential.

According to one embodiment of the display panel of the present disclosure, all of the driving transistor, the first transistor, the second transistor and the third transistor are low-temperature polysilicon thin film transistors, oxide semiconductor thin film transistors or amorphous silicon thin film transistor.

According to one embodiment of the display panel of the present disclosure, the light-emitting device is a light-emitting diode.

The pixel driving circuit and the display panel are provided by the embodiments of the present disclosure. The pixel driving circuit adopts a pixel driving circuit of 4T1C structure to effectively compensate the threshold voltage of the driving transistor in each pixel. A compensation structure of the pixel driving circuit and an operation difficulty are simple. By compensating the threshold voltage of the driving transistor through two compensation phases, it can achieve a wider compensation range of the threshold voltage, thereby improving the brightness and life of the display panel.

DESCRIPTION OF DRAWINGS

In order to more clearly illustrate the embodiments or the technical solutions in the prior art or the embodiment, the figures used in the description of the embodiments or the prior art will be briefly introduced below. Obviously, the figures in the following description are merely some embodiments of the present disclosure, for those of ordinary skill in the art, other figures may be obtained based on these figures without inventive steps.

DETAILED DESCRIPTION OF PREFERRED EMBODIMENTS

The technical solutions in the embodiments of the present disclosure will be described clearly and completely with reference to the figures in the embodiments of the present disclosure. Obviously, the described embodiments are only a part of the embodiments of the present disclosure, but not all the embodiments. Based on the embodiments of the present disclosure, all other embodiments obtained by those skilled in the art without inventive steps fall within the protection scope of the present disclosure.

Transistors used in all the embodiments of the present disclosure may be thin film transistors, field effect transistors or other devices with the same characteristics. Since a source and a drain of the transistors used here are symmetrical, the source and drain can be interchanged. In the embodiments of the present disclosure, in order to distinguish two electrodes of the transistor except a gate, one of the electrodes is called a source electrode, and another electrode is called a drain electrode. According to the figure, a middle terminal of the switching transistor is a gate, a signal input terminal is a source, and an output terminal is a drain. In addition, the transistors used in the embodiments of the present disclosure may include P-type transistors and/or N-type transistors, wherein the P-type transistor is turned on when the gate is at a low electrical potential, and is turned off when the gate is at a high electrical potential; the N-type transistor is turned on when the gate is at the high electrical potential, and is turned off when the gate is at the low electrical potential.

Figure 1:
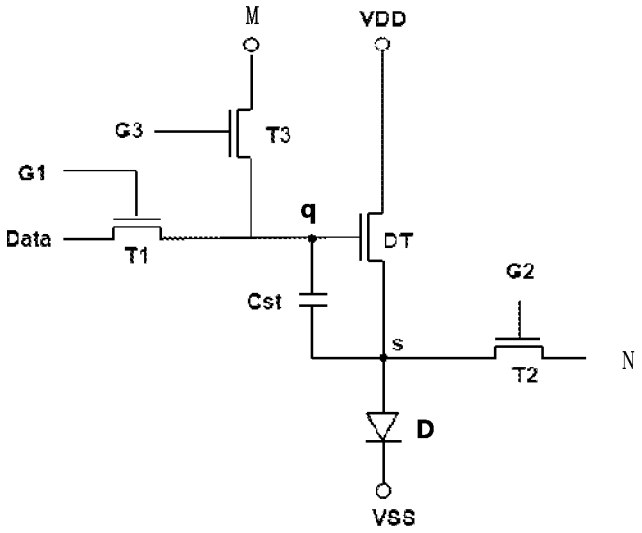
FIG. 1 is a schematic structural diagram of one embodiment of a pixel driving circuit of the present disclosure.

Please refer to FIG. 1, FIG. 1 is a schematic structural diagram of one embodiment of a pixel driving circuit of the present disclosure. As shown in FIG. 1, the pixel driving circuit of one embodiment of the present disclosure includes: a driving transistor DT, a first transistor T1, a second transistor T2, a third transistor T3, a capacitor Cst, and a light-emitting device D. The light-emitting device D may be an organic light-emitting diode. That is, the embodiments of the present disclosure adopt a pixel driving circuit with a 4T1C structure to effectively compensate a threshold voltage Vth of the driving transistor DT in each pixel, using fewer components, having a simple and stable structure, and saving costs.

A gate of the driving transistor DT is electrically connected to a first node q, a source of the driving transistor DT is electrically connected to a first power supply voltage VDD, and a drain of the driving transistor DT is electrically connected to a second node s. A gate of the first transistor T1 is electrically connected to a first control signal G1, a source of the first transistor T1 is electrically connected to a data signal Data, and a drain of the first transistor T1 is electrically connected to the first node q. A gate of the second transistor T2 is electrically connected to a second control signal G2, a source of the second transistor T2 is electrically connected to a first reference signal M, and a drain of the second transistor T2 is electrically connected to the second node s. A gate of the third transistor T3 is electrically connected to a third control signal G3, a source of the third transistor T3 is electrically connected to a second reference signal N, and a drain of the third transistor T3 is electrically connected to the first node q. One terminal of the capacitor Cst is electrically connected to the first node q, and another terminal of the capacitor Cst is electrically connected to the second node s. An anode of the light-emitting device D is electrically connected to the second node s, and a cathode of the light-emitting device D is electrically connected to a second power supply voltage VSS.

In some embodiments, all of the driving transistor DT, the first transistor T1, the second transistor T2, and the third transistor T3 are low-temperature polysilicon thin film transistors, oxide semiconductor thin film transistors, or amorphous silicon thin film transistors. The transistors in the pixel driving circuit provided by the embodiments of the present disclosure are the same type of transistors, so as to avoid influence of differences between different types of transistors on the pixel driving circuit.

Figure 2:
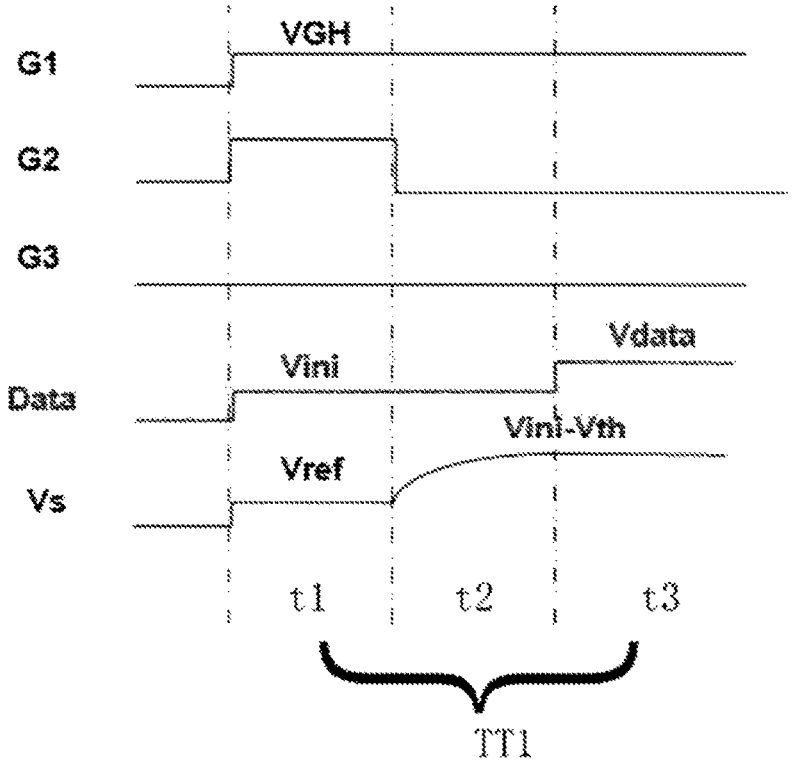
FIG. 2 is a timing diagram corresponding to a first compensation phase of one embodiment of the pixel driving circuit of the present disclosure.
Figure 3:
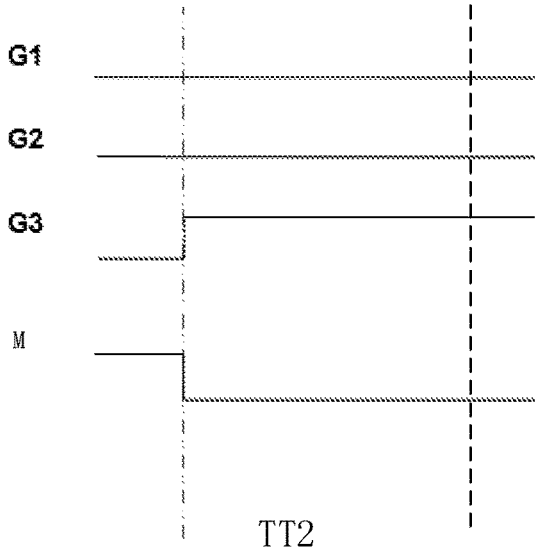
FIG. 3 is a timing diagram corresponding to a second compensation phase of one embodiment of the pixel driving circuit of the present disclosure.

Please refer to FIG. 2 and FIG. 3. FIG. 2 is a timing diagram corresponding to a first compensation phase TT1 of one embodiment of the pixel driving circuit of the present disclosure. FIG. 3 is a timing diagram corresponding to a second compensation phase TT2 of one embodiment of the pixel driving circuit of the present disclosure. As shown in FIGS. 2 and 3, a combination of the first control signal G1, the second control signal G2, and the third control signal G3 sequentially correspond to the first compensation phase TT1 and the second compensation phase TT2. During the first compensation phase TT1, the third control signal G3 is at the low electrical potential, the pixel driving circuit compensating the threshold voltage Vth of the driving transistor DT according to the first control signal G1, the second control signal G2, the data signal Data, and the first reference signal M. During the second compensation phase TT2, the third control signal G3 is at the high electrical potential, the first control signal G1 and the second control signal G2 are both at the low electrical potential, the pixel driving circuit negatively drift the threshold voltage Vth of the driving transistor DT according to the second reference signal N.

That is, in the embodiment of the present disclosure, the threshold voltage Vth of the driving transistor DT is obtained through the first compensation phase TT1, and then achieving the first compensation of the pixel driving circuit; subsequently, during the second compensation phase TT2, the pixel driving circuit negatively drifts the threshold voltage Vth of the driving transistor DT with the second reference signal N, thereby achieving the second compensation of the pixel driving circuit.

Further, the first compensation phase TT1 includes a reference electrical potential acquisition sub-phase t1, a threshold voltage acquisition sub-phase t2, and a light-emitting sub-phase t3. The data signal Data includes a first reference electrical potential Vini and a data electrical potential Vdata, the first reference signal M includes a second reference electrical potential Vref. During the reference electrical potential acquisition sub-phase t1, an electrical potential of the first node q is the first reference electrical potential Vini, an electrical potential of the second node s is the second reference electrical potential Vref. During the threshold voltage acquisition sub-phase t2, the electrical potential of the first node q is the first reference electrical potential Vini, and the electrical potential of the second node s gradually changes from the second reference electrical potential Vref to a difference between the first reference electrical potential Vini and the threshold voltage Vth of the driving transistor DT. During the light-emitting sub-phase t3, the electrical potential of the first node q is the data electrical potential Vdata, and the electrical potential of the second node s is a difference electrical potential between the first reference electrical potential Vini and the threshold voltage Vth of the driving transistor DT.

In some embodiments, during the reference electrical potential acquisition sub-phase t1, both the first control signal G1 and the second control signal G2 are at the high electrical potential, an electrical potential of the data signal Data is the first reference electrical potential Vini, and an electrical potential of the first reference signal M is the second reference electrical potential Vref.

In some embodiments, during the threshold voltage acquisition sub-phase t2, the first control signal G1 is at the high electrical potential, the second control signal G2 is at the low electrical potential, and the electrical potential of the data signal Data is the first reference electrical potential Vini.

In some embodiments, during the light-emitting sub-phase t3, the first control signal G1 is at the high electrical potential, the second control signal G2 is at the low electrical potential, and the electrical potential of the data signal Data is the data electrical potential Vdata.

In some embodiments, during the second compensation phase TT2, an electrical potential of the second reference signal N is the low electrical potential.

Figure 4:
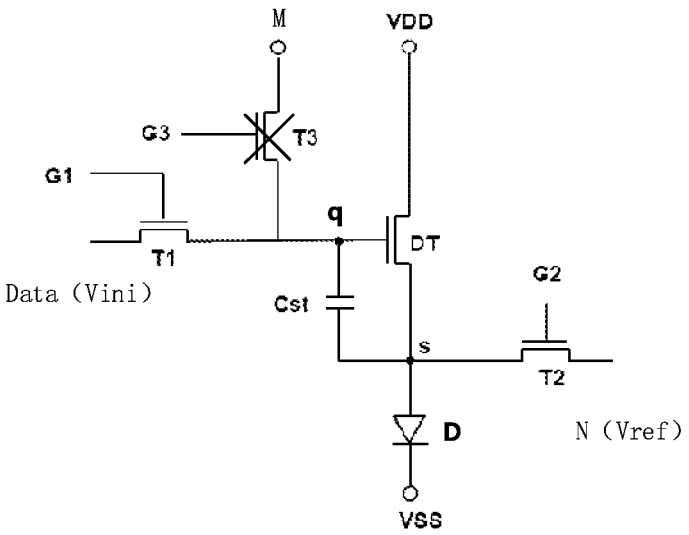
FIG. 4 is a schematic diagram of a path of reference electrical potential acquisition sub-phase under a driving time sequence shown in FIG. 2 of one embodiment of the pixel driving circuit of the present disclosure.

Please refer to FIG. 4. FIG. 4 is a schematic diagram of a path of reference electrical potential acquisition sub-phase under a driving time sequence shown in FIG. 2 of one embodiment of the pixel driving circuit of the present disclosure. First, referring to FIG. 2 and FIG. 4, during the reference electrical potential acquisition sub-phase t1, the first control signal G1 is at the high electrical potential, the second control signal G2 is at the high electrical potential, and the third control signal G3 is at the low electrical potential. At this time, the first transistor T1 and the second transistor T2 are turned on, and the third transistor T3 is turned off.

Specifically, since the first control signal G1 is at the high electrical potential, and at this time, the electrical potential of the data signal Data is the first reference electrical potential Vini, so that the first transistor T1 is turned on, and the first reference electrical potential Vini is output through the first transistor T1 to the first node q. Since the second control signal G2 is at the high electrical potential, and at this time, the electrical potential of the first reference signal M is the second reference electrical potential Vref, so that the second transistor T2 is turned on, and the second reference electrical potential Vref is output to the second node through the second transistor T2 s. That is, in the reference electrical potential acquisition sub-phase t1, both the first node q and the second node s are initialized.

Figure 5:
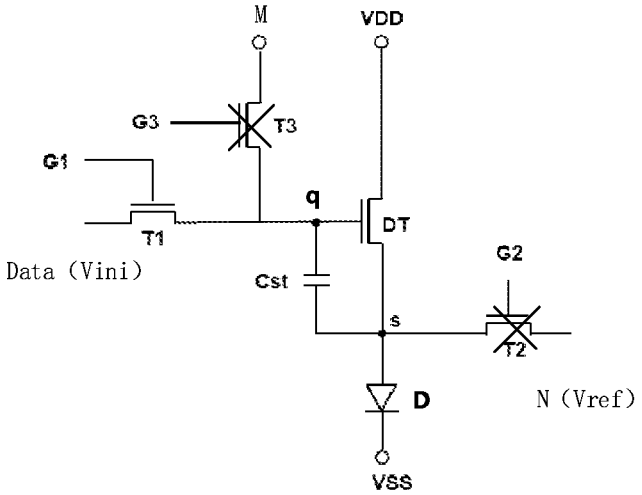
FIG. 5 is a schematic diagram of a path of threshold voltage acquisition sub-phase under the driving time sequence shown in FIG. 2 of one embodiment of the pixel driving circuit of the present disclosure.

Next, please refer to FIG. 5. FIG. 5 is a schematic diagram of a path of threshold voltage acquisition sub-phase under the driving time sequence shown in FIG. 2 of one embodiment of the pixel driving circuit of the present disclosure. During the threshold voltage acquisition sub-phase t2, the first control signal G1 is at the high electrical potential, the second control signal G2 is at the low electrical potential, and the third control signal G3 is at the low electrical potential. At this time, the first transistor T1 is turned on, and the second transistor T2 and the third transistor T3 are turned off.

Specifically, since the first control signal G1 is at the high electrical potential, and at this time, the electrical potential of the data signal Data is the first reference electrical potential Vini, so that the first transistor T1 is turned on, and the first reference electrical potential Vini is output through the first transistor T1 to the first node q. Since the second control signal G2 is at the low electrical potential, the second transistor T2 is turned off. At the same time, the driving transistor DT is turned on, and the capacitor Cst is discharged until the electrical potential of the second node s changes from the second reference electrical potential Vref to the difference between the first reference electrical potential Vini and the threshold voltage Vth of the driving transistor DT. The transistor DT is turned off, so that the threshold voltage Vth of the driving transistor DT is obtained.

Figure 6:
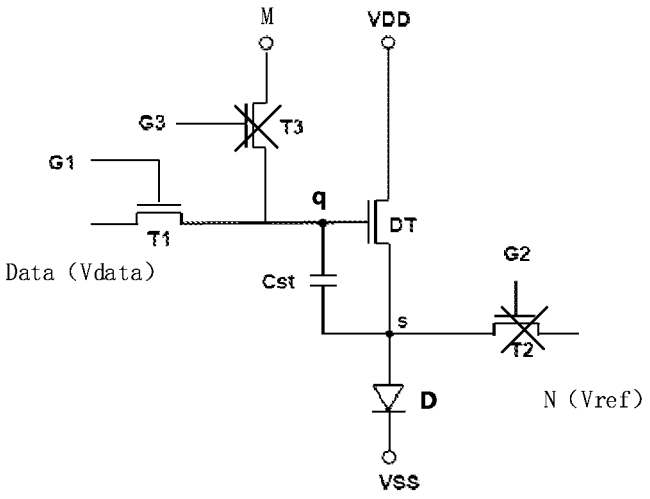
FIG. 6 is a schematic diagram of a path of light-emitting sub-phase under the driving time sequence shown in FIG. 2 of one embodiment of the pixel driving circuit of the present disclosure.

Finally, please refer to FIG. 6, FIG. 6 is a schematic diagram of a path of the light-emitting sub-phase t3 under the driving time sequence shown in FIG. 2 of one embodiment of the pixel driving circuit of the present disclosure. With reference to FIGS. 2 and 6, during the light-emitting sub-phase t3, the first control signal G1 is at the high electrical potential, the second control signal G2 is at the low electrical potential, and the third control signal G3 is at the low electrical potential. At this time, the first transistor T1 is turned on, and the second transistor T2 and the third transistor T3 are turned off.

Specifically, since the first control signal G1 is at the high electrical potential, and at this time, the electrical potential of the data signal Data is the data electrical potential Vdata, so that the first transistor T1 is turned on, and the data electrical potential Vdata is output to the first node q through the first transistor T1. Since the second control signal G2 is at the low electrical potential, the second transistor T2 is turned off. At the same time, the driving transistor DT is switched from off to on, and the light-emitting device D emits light.

Figure 7:
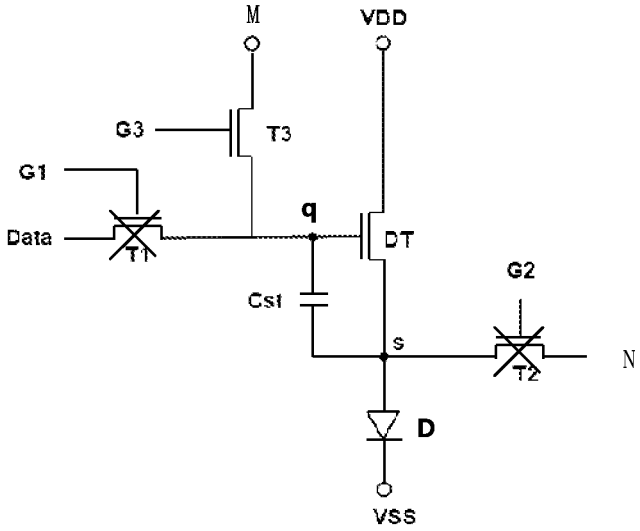
FIG. 7 is a schematic diagram of a path of the second compensation phase under the driving time sequence shown in FIG. 3 of one embodiment of the pixel driving circuit of the present disclosure.

Further, please refer to FIG. 7, FIG. 7 is a schematic diagram of a path of the second compensation phase under the driving time sequence shown in FIG. 3 of one embodiment of the pixel driving circuit of the present disclosure. With reference to FIGS. 2 and 7, during the second compensation phase TT2, the first control signal G1 is at the low electrical potential, the second control signal G2 is at the low electrical potential, and the third control signal G3 is at the high electrical potential. At this time, the third transistor T3 is turned on, and the first transistor T1 and the second transistor T2 are turned off.

Specifically, since the third control signal G3 is at the high electrical potential, and at this time, the electrical potential of the second reference signal N is the low electrical potential, the third transistor T3 is turned on, and the low electrical potential of the second reference signal N is output through the third transistor T3 to the first node q, thereby negatively drift the threshold voltage Vth of the driving transistor DT.

One embodiment of the present disclosure further provides a display panel, which includes the pixel driving circuit described above. For details, reference may be made to the above description of the pixel driving circuit, and details are not described herein.

The pixel driving circuit and the display panel provided by the embodiments of the present disclosure adopts a pixel driving circuit with a 4T1C structure to effectively compensate the threshold voltage Vth of the driving transistor DT in each pixel. A compensation structure of the pixel driving circuit is simple and easy to operate. By compensating the threshold voltage Vth of the driving transistor DT through two compensation phases, it can achieve a wider compensation range of the threshold voltage Vth, thereby improving the brightness and lifespan of the display panel.

The above are only embodiments of the present disclosure and do not limit the patent protection scope of the present disclosure. Any equivalent structure or equivalent process transformation made by the description and figures of the present disclosure, or directly or indirectly used in other related technical fields, are also included in the patent protection scope of the present disclosure.

What is claimed is:

1. A pixel driving circuit, comprising a driving transistor, a first transistor, a second transistor, a third transistor, a capacitor, and a light-emitting device;

wherein a gate of the driving transistor is electrically connected to a first node, a source of the driving transistor is electrically connected to a first power supply voltage, and a drain of the driving transistor is electrically connected to a second node;

a gate of the first transistor is electrically connected to a first control signal, a source of the first transistor is electrically connected to a data signal, and a drain of the first transistor is electrically connected to the first node;

a gate of the second transistor is electrically connected to a second control signal, a source of the second transistor is electrically connected to a first reference signal, and a drain of the second transistor is electrically connected to the second node;

a gate of the third transistor is electrically connected to a third control signal, a source of the third transistor is electrically connected to a second reference signal, and a drain of the third transistor is electrically connected to the first node;

one terminal of the capacitor is electrically connected to the first node, and another terminal of the capacitor is electrically connected to the second node; and an anode of the light-emitting device is electrically connected to the second node, a cathode of the light-emitting device is electrically connected to a second power supply voltage;

wherein a combination of the first control signal, the second control signal, and the third control signal sequentially corresponds to a first compensation phase and a second compensation phase, and wherein the first compensation phase comprises a reference electrical potential acquisition sub-phase, a threshold voltage acquisition sub-phase, and a light-emitting sub-phase, the data signal comprises a first reference electrical potential and a data electrical potential, and the first reference signal comprises a second reference electrical potential;

during the first compensation phase, the third control signal is at a low electrical potential, and the pixel driving circuit compensating a threshold voltage of the driving transistor according to the first control signal, the second control signal, the data signal, and the first reference signal;

during the second compensation phase, the third control signal is at a high electrical potential, the first control signal and the second control signal are both at the low electrical potential, and the pixel driving circuit negatively drift the threshold voltage of the driving transistor according to the second reference signal;

during the reference electrical potential acquisition sub-phase, an electrical potential of the first node is the first reference electrical potential, and an electrical potential of the second node is the second reference electrical potential;

during the threshold voltage acquisition sub-phase, the electrical potential of the first node is the first reference electrical potential, and the electrical potential of the second node gradually changes from the second reference electrical potential to a difference between the first reference electrical potential and the threshold voltage of the driving transistor; and during the light-emitting sub-phase, the electrical potential of the first node is the data electrical potential, and the electrical potential of the second node is a difference electrical potential between the first reference electrical potential and the threshold voltage of the driving transistor.

2. The pixel driving circuit as claimed in claim 1, wherein during the reference electrical potential acquisition sub-phase, both the first control signal and the second control signal are at the high electrical potential, an electrical potential of the data signal is the first reference electrical potential, and an electrical potential of the first reference signal is the second reference electrical potential.

3. The pixel driving circuit as claimed in claim 1, wherein during the threshold voltage acquisition sub-phase, the first control signal is the high electrical potential, the second control signal is the low electrical potential, and an electrical potential of the data signal is the first reference electrical potential.

4. The pixel driving circuit as claimed in claim 1, wherein during the light-emitting sub-phase, the first control signal is the high electrical potential, the second control signal is the low electrical potential, and an electrical potential of the data signal is the data electrical potential.

5. The pixel driving circuit as claimed in claim 1, wherein during the second compensation phase, an electrical potential of the second reference signal is the low electrical potential.

6. The pixel driving circuit as claimed in claim 1, wherein all of the driving transistor, the first transistor, the second transistor and the third transistor are low-temperature polysilicon thin film transistors, oxide semiconductor thin film transistors, or amorphous silicon thin film transistors.

7. The pixel driving circuit as claimed in claim 1, wherein the light-emitting device is a light-emitting diode.

8. A display panel, comprising a pixel driving circuit, wherein the pixel driving circuit comprising a driving transistor, a first transistor, a second transistor, a third transistor, a capacitor, and a light-emitting device;

a gate of the driving transistor is electrically connected to a first node, a source of the driving transistor is electrically connected to a first power supply voltage, and a drain of the driving transistor is electrically connected to a second node;

a gate of the first transistor is electrically connected to a first control signal, a source of the first transistor is electrically connected to a data signal, and a drain of the first transistor is electrically connected to the first node;

a gate of the second transistor is electrically connected to a second control signal, a source of the second transistor is electrically connected to a first reference signal, and a drain of the second transistor is electrically connected to the second node;

a gate of the third transistor is electrically connected to a third control signal, a source of the third transistor is electrically connected to a second reference signal, and a drain of the third transistor is electrically connected to the first node;

one terminal of the capacitor is electrically connected to the first node, and another terminal of the capacitor is electrically connected to the second node; and an anode of the light-emitting device is electrically connected to the second node, a cathode of the light-emitting device is electrically connected to a second power supply voltage;

wherein a combination of the first control signal, the second control signal, and the third control signal sequentially corresponds to a first compensation phase and a second compensation phase, and wherein the first compensation phase comprises a reference electrical potential acquisition sub-phase, a threshold voltage acquisition sub-phase, and a light-emitting sub-phase, the data signal comprises a first reference electrical potential and a data electrical potential, and the first reference signal comprises a second reference electrical potential;

during the first compensation phase, the third control signal is at a low electrical potential, and the pixel driving circuit compensating a threshold voltage of the driving transistor according to the first control signal, the second control signal, the data signal, and the first reference signal;

during the second compensation phase, the third control signal is at a high electrical potential, the first control signal and the second control signal are both at the low electrical potential, and the pixel driving circuit negatively drift the threshold voltage of the driving transistor according to the second reference signal;

during the reference electrical potential acquisition sub-phase, an electrical potential of the first node is the first reference electrical potential, and an electrical potential of the second node is the second reference electrical potential;

during the threshold voltage acquisition sub-phase, the electrical potential of the first node is the first reference electrical potential, and the electrical potential of the second node gradually changes from the second reference electrical potential to a difference electrical potential between the first reference electrical potential and the threshold voltage of the driving transistor; and during the light-emitting sub-phase, the electrical potential of the first node is the data electrical potential, and the electrical potential of the second node is the difference electrical potential between the first reference electrical potential and the threshold voltage of the driving transistor.

9. The display panel as claimed in claim 8, wherein during the reference electrical potential acquisition sub-phase, both the first control signal and the second control signal are at the high electrical potential, an electrical potential of the data signal is the first reference electrical potential, and an electrical potential of the first reference signal is the second reference electrical potential.

10. The display panel as claimed in claim 8, wherein during the threshold voltage acquisition sub-phase, the first control signal is the high electrical potential, the second control signal is the low electrical potential, and an electrical potential of the data signal is the first reference electrical potential.

11. The display panel as claimed in claim 8, wherein during the light-emitting sub-phase, the first control signal is the high electrical potential, the second control signal is the low electrical potential, and an electrical potential of the data signal is the data electrical potential.

12. The display panel as claimed in claim 8, wherein during the second compensation phase, an electrical potential of the second reference signal is the low electrical potential.

13. The display panel as claimed in claim 8, wherein all of the driving transistors, the first transistor, the second transistor and the third transistor are low-temperature polysilicon thin film transistors, oxide semiconductor thin film transistors or amorphous silicon thin film transistors.

14. The display panel as claimed in claim 8, wherein the light-emitting device is a light-emitting diode.

* * * * *